United States Patent [19]

Mancini et al.

[11] 4,418,826

[45] Dec. 6, 1983

[54] CONTAINER SPACE FILLER

[75] Inventors: Gerardo Mancini; Richard J. Searle, both of London; Eugene E. Davis, Ilford, all of England

[73] Assignee: Johnsen & Jorgensen Limited, London, England

[21] Appl. No.: 365,900

[22] Filed: Apr. 6, 1982

[30] Foreign Application Priority Data

Apr. 7, 1981 [GB] United Kingdom ..... 8110814
Jun. 9, 1981 [GB] United Kingdom ..... 8117549

[51] Int. Cl.[3] ..... B65D 25/10
[52] U.S. Cl. ..... 215/231
[58] Field of Search ..... 215/231; 206/591; 220/93

[56] References Cited

U.S. PATENT DOCUMENTS 1,342,321 6/1920 Beler ..... 215/231
3,033,409 5/1962 Lind ..... 215/231 X

*Primary Examiner*—Donald F. Norton
*Attorney, Agent, or Firm*—Woodard, Weikart, Emhardt & Naughton

[57] ABSTRACT

A space filler designed to be disposed within a space in a filled container between the contents of the container and a closure cap for the container to minimize unwanted movement of the contents of the container, wherein the space filler comprises a base member to rest on the top of the contents of the container and a plurality of resilient spacer arms projecting upwardly from the base member, at least some of the resilient spacer arms being so shaped and dimensioned so that when in use they are compressed and deformed and make contact both with the inner surface of the top of the closure cap and with the inside side surface of the container.

4 Claims, 7 Drawing Figures

CONTAINER SPACE FILLER

This invention relates to fillers for filling the space between the lid or cap of a container and its contents. In order to enable pills, tablets and other small articles to be sold in groups of different numbers in the same size of container some form of packing is provided between the lid or cap of the container and its contents to prevent the contents becoming damaged. For example, it has been proposed to pack the containers with a padding such as expanded polyurethane but that sometimes discolours the pills.

It has also been proposed to use a packing of cotton wool but that is not wholly satisfactory because the cotton wool sometimes becomes trapped between the cap of the container and the container body thus forming a wick along which moisture can enter the container. It has also been proposed to provide an insert adapted to be used in vessels for tablets, pills or similar articles and adapted to be removably positioned over the contents of the vessel, the insert being made of resilient material and comprising a central body with arms extending therefrom of such length that the insert can be introduced through the mouth of the vessel only after bending of its arms against their resilient action. In practice however such an insert can be used only with a shouldered vessel so that the shoulder can be used to retain the insert in position while capping takes place.

In our British Pat. No. 1601124 we disclose a space filler designed to be disposed within a space in a filled container between the contents of the container and a closure cap for the container wherein before insertion into the container the space filler comprises a plate like base member and a plurality of resilient spacer arms projecting upwardly from the base member so as to extend over a part of the upper surface of the base member while being spaced therefrom, whereby when in use the lower surface of the base member rests upon the contents of the container and the arms make contact with an inner surface of the closure cap of the container so that the space filler minimises unwanted movement of the contents of the container.

The space filler disclosed in that Patent proved in trials to be very satisfactory with tablets but in some cases, for example with suger coated pills, it has been found that the space filler can tilt if the container be rocked due to the bearing action of the pills. If this happens then the contents of the container can be shaken past the base member into the space between the space filler and the closure cap in which case the filler fails to prevent unwanted movement of the contents. Our experiments have shown that this can happen especially with relatively large containers especially when filled containers are stored and transported in a substantially horizontal position.

Therefore, in accordance with the present invention we have provided an improved space filler designed to be disposed within a space in a filled container between the contents of the container and a closure cap or lid for the container to minimise unwanted movement of the contents of the container, the filler comprising a base and a plurality of resilient spacer arms projecting upwardly from the base, the resilient spacer arms being of such configuration and disposition that on closing the container the lower surface of the base rests upon the contents of the container, and the arms make contact both with an inner surface of the closure cap or lid and with the inside surface of the container.

In one embodiment the resilient spacer arms may be disposed adjacent the periphery of the base and curved inwardly towards the centre thereof so that on compression of the spacer arms during closure the spacer arms bow outwardly to press against the side wall of the container as well as being pressed downwardly by the underside of the cap or lid.

In a second embodiment the spacer arms are disposed adjacent the periphery of the base but are curved in clockwise or anti-clockwise direction about the base. On compression of the spacer arms in this embodiment the spacer arms are bent forwardly so as to overlap the edge of the base and thereby in use press against the inside wall of the container.

The invention will now be described by way of example with reference to the accompanying drawings in which.

Figure 1:
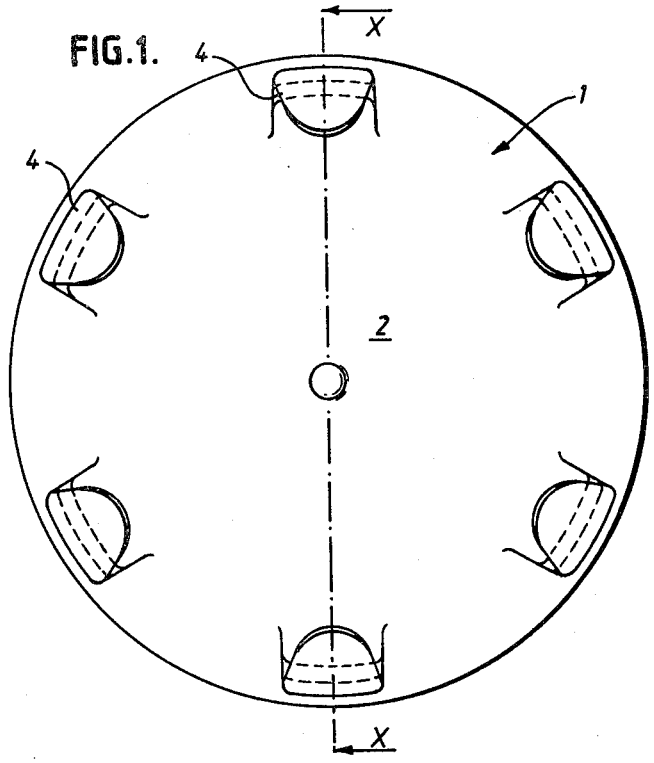
FIG. 1 is a plan view of a first embodiment of filler in accordance with the present invention.
Figure 2:
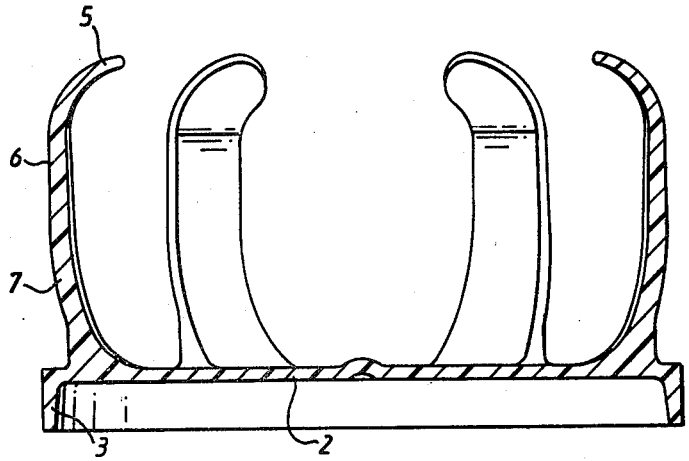
FIG. 2 is a section on X—X in FIG. 1.
Figure 3:
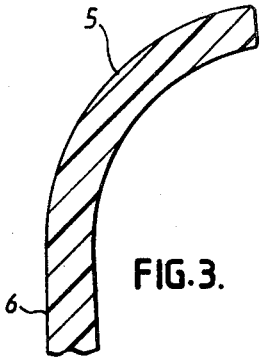
FIG. 3 is an enlargement of one of the arm ends.
Figure 5:
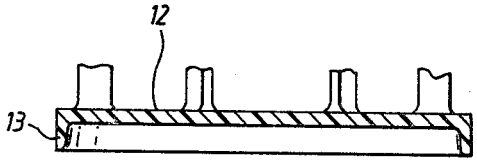
FIG. 5 is a section of the filler shown in FIG. 4 with the arms broken away.
Figure 4:
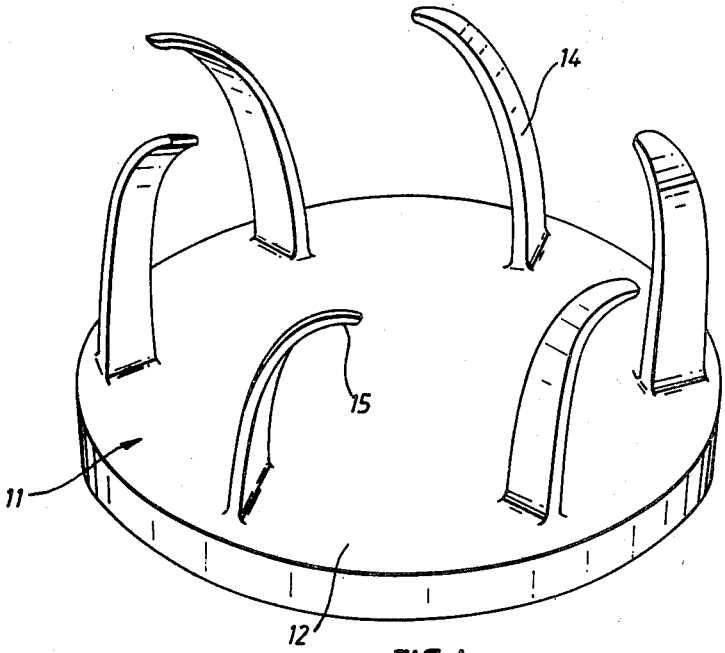
FIG. 4 is a perspective view of a second embodiment of filler in accordance with the present invention.

In the drawings the first embodiment a filler 1 comprises a substantially circular base 2 with a peripheral flange 3 depending from its underside face. The upper face of the base 2 includes six, upwardly projecting, spacer arms 4 equidistantly spaced about the periphery of the base 2. The spacer arms 4 are specially shaped and each have three distinct portions: an upper portion 5 curved inwardly towards the centre of the base 2; a centre portion 6 extending in a direction substantially perpendicular to the base 2 and inset just slightly from the periphery of the base 2 as clearly seen from FIG. 2; and a lower portion 7 which curves inwardly from the centre portion 6 and increases in cross-section towards its union with the base 2. In the second embodiment there is disclosed a filler 11 comprising a substantially circular base 12 having a peripheral flange 13 depending from its underside face as in the first embodiment. Projecting upwardly from the upper face of the base 12 are also six spacer arms 14 as before. However, instead of the spacer arms 14 being curved towards the centre of the base, they are curved clockwise or anti-clockwise about the base 12. With this arrangement the spacer arms 14 are more regularly curved with the curvature increasing towards their upper portions 15.

In use a container is filled with a number of articles, such as tablets. The filler 1 or 11 is then inserted on the top of the articles with the peripheral flange 3 or 13 locating against the inside of the container wall so as to act as a guide. The lid or cap for the container is then closed upon the top of the container so that the spacer arms 4 or 14 are compressed by bowing or bending between the lid or cap and the base 2 or 12 of the filler. In this way the underside face of the base rests on the top of the contents of the container and the upper portions of the spacer arms 4 or 14 are in contact with the underside of the cap. In addition, because of the location and configuration of the spacer arms 4 or 14, the spacer arms are braced against the side wall of the container in order to prevent any tendency for the filler to become displaced during transit.

In the first embodiment the compression of the spacer arms 4, during closure of the container, causes the centre portion 6 of the arms to bow outwardly. Thus, once closed, the upper portions 5 engage the underside of the lid or cap and the centre portions 6 of the spacer arms 4 are braced against the side walls. The fact that the centre portions 6 are substantially flat rather than curved means that there is larger surface contact between the arms 4 and the side wall counteracting any tendency for the spacer arms to act as a pivot about which the filler can turn out of its intended position.

Figure 6:
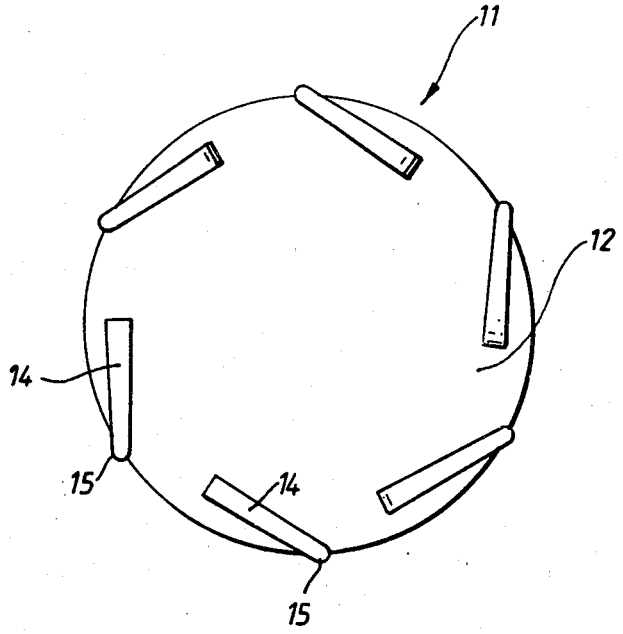
FIG. 6 is a diagrammatic plan view of the second embodiment with the spacer arms shown compressed.

In the second embodiment the spacer arms 14 are compressed in peripheral direction so that, rather than bowing outwardly, the upper portions 15 are caused to engage the container wall at a position forwardly of the respective spacer arm 14—see FIG. 6 where two spacer arms 14 are shown (the others omitted for clarity) with their compressed upper portions 15 overlapping the periphery of the base 12 so that, in use, the upper portions 15 will be braced against the inside wall of the container.

In this way the spacer arms acting between the underside of the lid or cap and the side walls of the container prevent any tendency for the filler to become displaced. We have found that the preferred number of spacer arms is six but more or less spacer arms may prove suitable depending upon their angular position and the size of container with which the filler is to be used.

Figure 7:
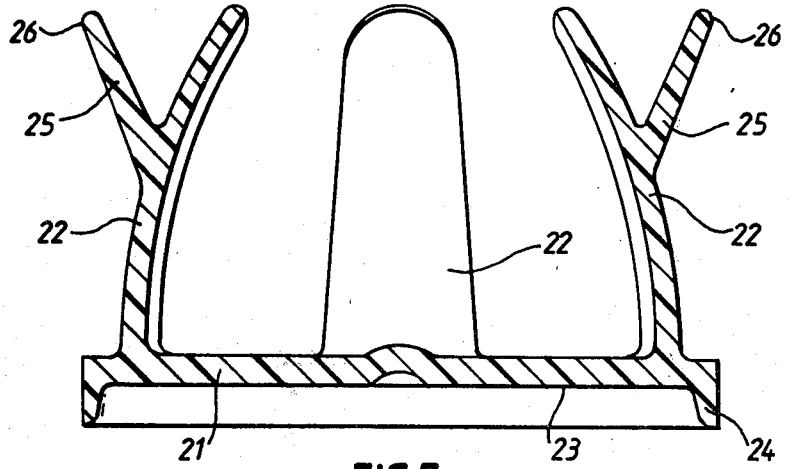
FIG. 7 is a sectional view of a third embodiment of filler in accordance with the present invention.

In a third embodiment illustrated in FIG. 7 in section a space filler has a base member 21 and a plurality, in this case four, of spacer arms 22, the arms 22 projecting upwardly and inwardly from the base member 21. The base member 21 is substantially planar on its lower surface 23, the planar surface being broken only by the provision of an annular flange 24. Each arm 22 has an upwardly and outwardly projecting contact member in the form of a finger 25. The four arms 22 are equidistantly arranged around the base member 21 so that each arm 22 is diametrically opposite to another arm 22, the distance from the outer end 26 of one finger 25 to the outer end 26 of the finger 25 in the diametrically opposed arm 22 being greater than the internal diameter of the container for which the space filler is designed. By this arrangement when the space filler is inserted into a container the finters 25 are slightly deformed by inward pressure so that the fingers press against the inside surface of the container and positively hold the filler in operative position. The space fillter is preferably inserted downwardly into its container in the position shown in the drawing so that the fingers 25 although wider apart at their ends than the internal diameter of the container do not impede insertion of the filler into its operative position.

In all the embodiments the base member is essentially of plate-like formation with an upper surface and a lower surface, the plate being substantially planar at least on its lower surface so that when in use the lower surface of the base member of the space filler can rest upon the top of the articles within a container.

It will be understood that the invention includes not only the space filler per se but also a container comprising a body with a top end and a bottom end, the body being closed at the bottom end and open at the top end to receive a group of articles, a container closure to close the open end of the container and a space filler separate from the container body and from the closure for disposal between the top of the group of articles and the closure when the container has been filled, the space filler being shaped as described above in relation to any of the embodiments.

The space filler is preferably made of a suitable plastics material adapted to impart a resilient capability to the arms when in operation, e.g. polyethylene or polypropylene.

We claim:

1. A space filler designed to be disposed within a space in a filled container between the top of the contents of the container, the inner surface of the closure cap for the container and the inside side surface of the container to minimize unwanted movement of the contents of the container, said space filler comprising a base member adapted to rest on said top of the contents of the container and a plurality of resilient spacer arms projecting upwardly from said base member so that when in use at least some of said spacer arms are compressed and deformed and make contact with said inner surface of the closure cap and with said inside side surface of the container, said spacer arms are disposed adjacent to the periphery of said base member and are curved inwardly towards the centre thereof so that in operation on compression of the spacer arms during closure of said container the arms bow outwardly to press against said inside side surface of the container as well as being pressed downwardly by said inner surface of the closure cap.

2. A space filler designed to be disposed within a space in a filled container between the top of the contents of the container, the inner surface of the closure cap for the container and the inside side surface of the container to minimize unwanted movement of the contents of the container, said space filler comprising a base member adapted to rest on said top of the contents of the container and a plurality of resilient spacer arms projecting upwardly from said base member so that when in use at least some of said spacer arms are compressed and deformed and make contact with said inner surface of the closure cap and with said inside side surface of the container, said spacer arms are disposed adjacent to the periphery of said base member and are curved along their length relative to said base member so that on compression said arms are bent so as to overlap the edge of said base member and to press against said inside wall of the container.

3. A space filler designed to be disposed within a space in a filled container between the top of the contents of the container, the inner surface of the closure cap for the container and the inside side surface of the container to minimize unwanted movement of the contents of the container, said space filler comprising a base member adapted to rest on said top of the contents of the container and a plurality of resilient spacer arms projecting upwardly from said base member so that when in use at least some of said spacer arms are compressed and deformed and make contact with said inner surface of the closure cap and with said inside side surface of the container, each of said plurality of spacer arms has an inwardly curved upper portion, a centre portion extending in a direction substantially perpendicular to said base member and a lower portion which curves inwardly and increases in cross-section towards its union with said base member.

4. A space filler designed to be disposed within a space in a filled container between the contents of the container and a closure cap for the container to minimize unwanted movement of the contents of the container, wherein the space filler comprises a generally cylindrical base member adapted to rest on the top of the contents of the container and a plurality of resilient spacer arms disposed within the outer periphery of said base member and extending upwardly from the base member and arranged so as to project from the mouth of the container before the closure cap is applied, said space filler being adapted such that at least some of the resilient spacer arms are curved at the top so that the space filler facilitates the application of the closure cap to the container and so that when the cap is in position the space filler is compressed between the cap and the contents of the container and the spacer arms are deformed by their contact with the inner surface of the top of the closure cap so as to be pressed against the inside surface of the container.

* * * * *

UNITED STATES PATENT AND TRADEMARK OFFICE

CERTIFICATE OF CORRECTION

PATENT NO. : 4,418,826

DATED : December 6, 1983

INVENTOR(S) : Gerardo Mancini et al.

It is certified that error appears in the above-identified patent and that said Letters Patent is hereby corrected as shown below:

On the title page;

The name of the Assignee should read

--Johnsen & Jorgensen (Plastics), Ltd.--

Signed and Sealed this

*Second* Day of *July 1985*

[SEAL]

*Attest:*

DONALD J. QUIGG

*Attesting Officer* *Acting Commissioner of Patents and Trademarks*